United States Patent [19]

Wehner

[11] Patent Number: 4,479,627

[45] Date of Patent: Oct. 30, 1984

[54] CHAIR HEIGHT ADJUSTMENT MECHANISM

[75] Inventor: Robert L. Wehner, Parkville, Mo.

[73] Assignee: Cramer Inc., Kansas City, Kans.

[21] Appl. No.: 465,563

[22] Filed: Feb. 10, 1983

[51] Int. Cl.[3] ..... F16M 11/00

[52] U.S. Cl. ..... 248/406.2; 297/345

[58] Field of Search ..... 248/406, 405, 161, 542; 297/345, 349

[56] References Cited

U.S. PATENT DOCUMENTS

| | | | |
|---|---|---|---|
| 325,044 | 8/1885 | Blackburn . | |
| 699,889 | 5/1902 | Morsell . | |
| 1,041,701 | 10/1912 | Thornley . | |
| 1,184,483 | 5/1916 | Morsell . | |
| 1,207,412 | 12/1916 | Keeney . | |
| 2,388,056 | 10/1945 | Hendricks . | |
| 2,702,075 | 2/1955 | Richards . | |
| 2,704,113 | 3/1955 | McKinley . | |
| 2,764,223 | 9/1956 | Mischke . | |
| 3,164,357 | 1/1965 | Hage et al. | 248/406 |
| 3,169,744 | 2/1965 | Mocek et al. . | |
| 3,227,113 | 1/1966 | Kupski . | |
| 3,327,985 | 6/1967 | Levit et al. . | |
| 3,534,937 | 10/1970 | Heinzel . | |
| 3,599,924 | 8/1971 | Schmidgall . | |
| 3,606,234 | 9/1971 | Prescott . | |
| 3,642,088 | 2/1972 | Snath . | |
| 3,727,871 | 4/1973 | Harper . | |
| 3,870,271 | 3/1975 | Bowman . | |
| 3,991,965 | 11/1976 | Westover et al. . | |
| 4,026,509 | 5/1977 | Wolters . | |
| 4,181,280 | 1/1980 | Bowman . | |
| 4,285,488 | 8/1981 | Hancock | 248/405 |
| 4,324,382 | 4/1982 | Beukema et al. . | |
| 4,394,001 | 7/1983 | Wisniewski | 297/345 |

*Primary Examiner*—J. Franklin Foss

*Attorney, Agent, or Firm*—Litman, Day and McMahon

[57] ABSTRACT

A chair height adjustment mechanism selectively positions a seat section relative to a base and is situated between a barrel attached to the chair base and a threaded spindle extending downwardly from the seat section and telescopically received within the barrel. The adjustment mechanism includes an adjusting nut assembly receiving the spindle and extending between the barrel and spindle. A spring urges the nut assembly toward engagement with a detent member connected to the barrel. When the seat section is occupied, the spring is compressed and the nut disengages from the detent member, and the spindle and nut rotate together as the seat section swivels. When the seat section is unoccupied, the spring urges the nut into interlocking engagement with the detent member, and the spindle rotates relative to the nut as the seat section swivels in order to cause the seat section and spindle to adjust upwardly and downwardly depending on the direction of seat rotation relative to the base and barrel.

6 Claims, 14 Drawing Figures

Fig. 5.
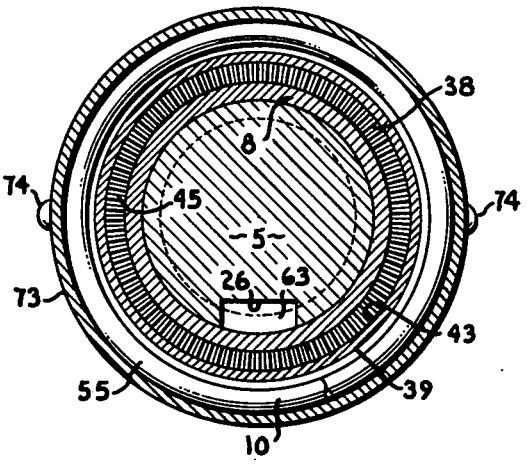
Fig. 9.
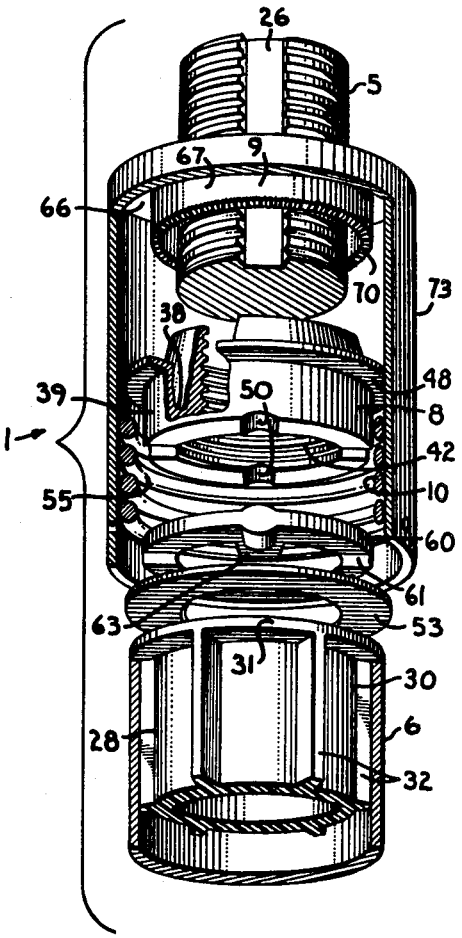
Fig. 6.
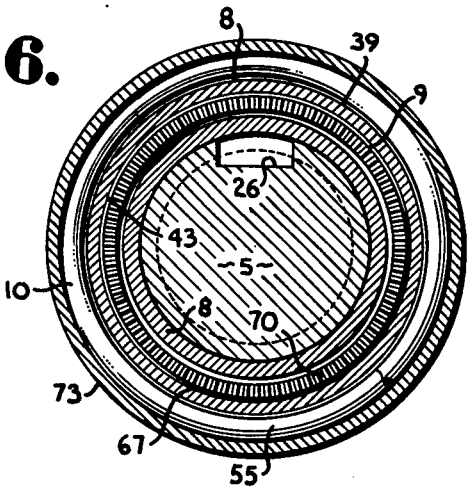
Fig. 7.
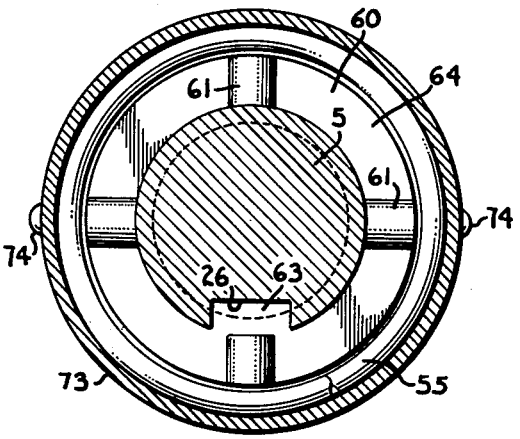
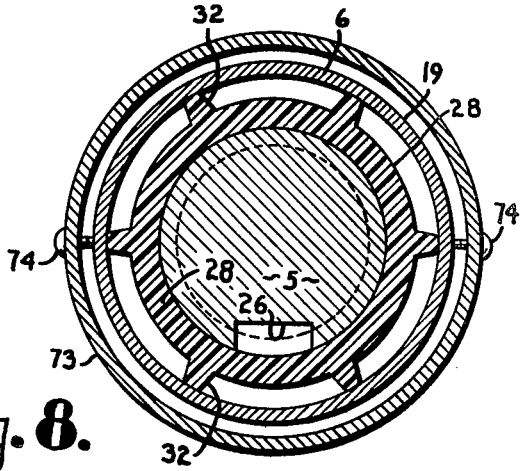
Fig. 8.

CHAIR HEIGHT ADJUSTMENT MECHANISM

BACKGROUND OF THE INVENTION

This invention relates to a chair height adjustment mechanism and in particular, to a mechanism which can be longitudinally adjusted by rotating an unoccupied seat section.

Rotatable or swivelable chairs developed for office and industrial use have ordinarily been adjustable to vary the height of the seat section relative to the chair base by reaching underneath the seat section and manually rotating an adjustment nut or collar or by withdrawing and reinserting a lock pin or pawl in a seat standard having a series of holes. These means are often unhandy to use and some have even subjected the chair seat to uncontrolled and hazardous collapse. More recent designs utilize a spindle which threadably engages a support column to more positively support the seat section and alleviate substantial possibility of inadvertent retraction or collapse.

Refinement of the spindle and support column arrangement, such as disclosed by Bowman, U.S. Pat. No. 3,870,271 eliminate the inconvenience of having to reach underneath the seat section in order to adjust chair height. In Bowman, a contact arm and lug extending downwardly from an adjusting nut eventually engage a stop extending radially from the hub tube so that rotation of the seat section when unoccupied causes the spindle to rotate relative to the adjusting nut, thereby adjusting the height of the seat section. When the chair is occupied, however, the contact means will not engage the stop and the seat section may be rotated without height adjustment. Unfortunately, this mechanism requires many parts, is complicated and accordingly expensive to construct. Moreover, the contact arm is susceptible to bending or breakage since the chair seat could conceivably be rotated 360 degrees before the contact arm slams against the stop.

Beukema, U.S. Pat. No. 4,324,382 developed a height adjustable chair base also directed to preventing rotation of an adjustment nut when the chair is unoccupied in order to allow height adjustment. The Beukema device requires a spring housing for supporting a support column and aligns the spring and a hub tube to cover an unsightly spindle extending upwardly from the base. The additional expense of the spring housing and hub tube adds substantially to the cost of the chair.

OBJECTS OF THE INVENTION

In view of the above, the principal objects of the present invention are: to provide a chair height adjustment mechanism which causes the seat to adjust upwardly and downwardly by rotating or swiveling an unoccupied seat section and which does not cause height adjustment when the seat is occupied; to provide such a mechanism which allows rotary movement of the seat section when occupied; to provide such a mechanism which is normally safe to operate; to provide such a mechanism which is easily adjustable; to provide such a mechanism which is resistent to wear and has a long operational life; to provide a mechanism which does not require cover tubes to be aesthetically pleasing; to provide such a mechanism which allows ease of maintenance; to provide such a device which is simple to manufacture and assemble; and to provide such a mechanism which is efficient in operation, economical to manufacture, and particularly well adapted for the proposed use.

Other objects and advantages of this invention will become apparent from the following descriptive specification taken in conjunction with the accompanying drawings wherein are set forth, by way of illustration and example, certain embodiments of this invention.

DESCRIPTION OF THE DRAWINGS

FIG. 5 is a top plan cross-sectional view taken along line 5—5, FIG. 3.

FIG. 6 is a cross-sectional view taken along line 6—6, FIG. 4.

FIG. 7 is a cross-sectional view taken along line 7—7, FIG. 2.

FIG. 8 is a cross-sectional view taken along line 8—8, FIG. 2.

FIG. 9 is an exploded pictorial view with portions broken away to show positioning of parts of the embodiment.

DESCRIPTION OF THE PREFERRED EMBODIMENT

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
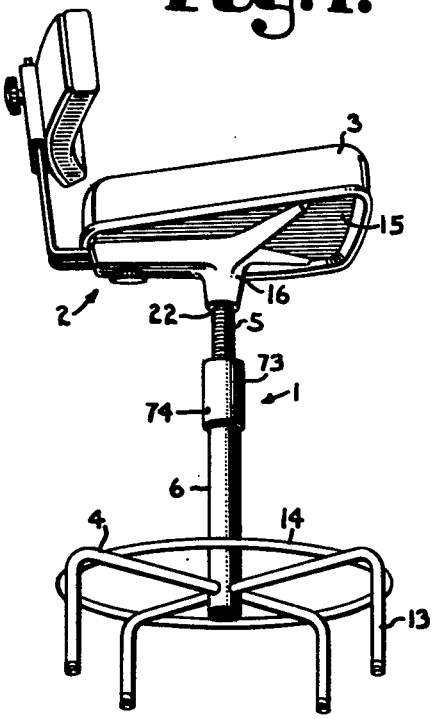
FIG. 1 is a perspective view of a chair showing a preferred embodiment of a height adjustment mechanism.

All directional qualities such as upward, downward, vertical or horizontal or derivatives thereof shall be considered as oriented in FIG. 1. A preferred embodiment of the invention as shown in FIGS. 1 through 9 and an alternative embodiment is shown in FIGS. 10 through 14.

Referring to the drawings in more detail:

The reference numeral 1, FIG. 1, generally indicates an adjustment mechanism such as used for selection of chair height and which selectively positions a rotatably mounted seat section relative to a base. An exemplary chair 2, FIG. 1, includes an upper seat section 3 and a bottom base 4 with a threaded spindle 5 depending from the seat section 3 and a barrel 6 secured to and extending upwardly from the base 4. The spindle 5 is fixed to the seat section 3 and turns as the seat section 3 rotates or swivels. The spindle 5 is telescopically received within the barrel 6 and selectively positioned therein by an adjusting nut assembly 7, FIG. 2, extending between the barrel 6 and the spindle 5. The adjusting nut assembly 7 includes a nut 8 threadably mounted on the spindle 5 and which is urged longitudinally of the barrel 6 by a biasing means 10 toward engagement with a detent member 9 connected to the barrel 6 and extending into selective interlocking engagement with the nut assembly 8.

The adjustment mechanism 1 facilitates longitudinal adjustment of the spindle 5 relative to the barrel 6 when insufficient compressive force is applied to the biasing means 10, as when the seat section 3 is unoccupied, so that the nut 8 engages the detent member 9 and is prevented from rotation relative to the barrel 6. The spindle 5 then is able to rotate relative to the nut 8 and move longitudinally of the barrel 6. When sufficient compressive force is applied to the biasing means 10, as by a person sitting on the seat section 3, the nut 8 is disengaged from the detent member 9 and able to rotate with the spindle 5 relative to the barrel 6 so that the spindle 5 is not able to move or adjust longitudinally of the barrel.

In the illustrated example, the chair base 4 includes a plurality of legs 13 attached to and extending outwardly and downwardly from the barrel 6. Preferably, a support structure or ring 14 is attached to the legs 13 and accommodates placement of a person's feet. Attached to a bottom side 15 of the seat section 3 is a seat support boss 16 receiving a top end of the spindle 5 and securing the spindle against rotation relative to the seat section 3.

The adjustment mechanism 1, though particularly adapted for chair use can be used in many other applications in which longitudinal adjustment is required, such as work tables and the like. While a particular orientation is illustrated, the orientation may be varied or moved from the upright position. Moreover, the positions of the spindle 5 and barrel 6 could be reversed and the barrel 6 could be attached to the seat section 3. Any of these orientations are within the concept of the present invention.

In the illustrated example, the barrel 6 is tubular, hollow, and may be cylindrical or otherwise in configuration. The barrel 6 has a distal or upper end 19 terminating in an abutment edge 20. Normally, the barrel 6 has its longitudinal axis substantially vertical.

Figure 2:
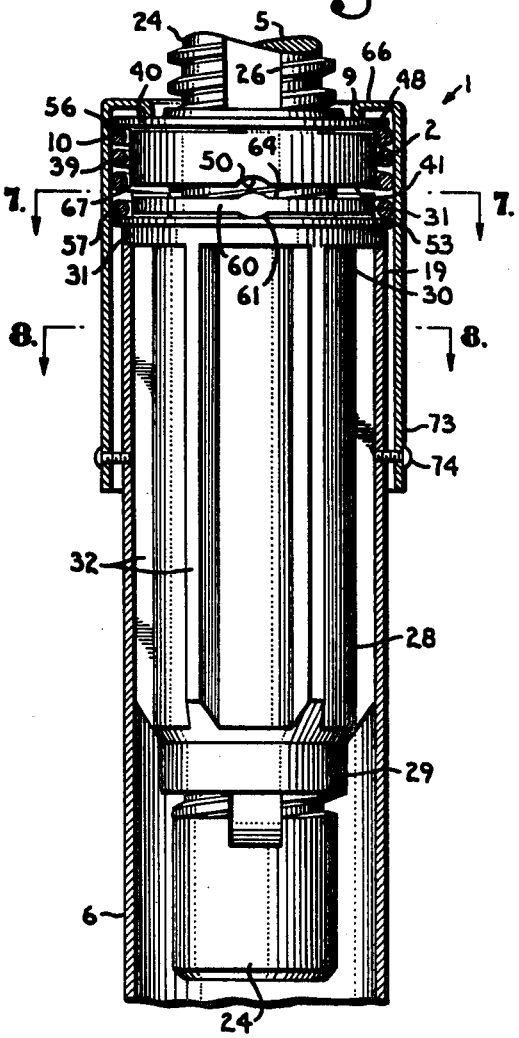
FIG. 2 is an enlarged, longitudinal sectional view of the preferred embodiment and showing its parts in one functional mode.

The spindle 21 has an upper end 22, a lower end 23 and a threaded intermediate portion 24, FIG. 2. The spindle upper end 22 is connected to the seat section 3 and the lower end 23 is telescopically received within the barrel 6. The intermediate portion 24 extends through the nut assembly 7 with the nut 8 threadably engaging the spindle 5. The spindle upper end 22 has a diameter sufficiently small to allow connection and removal of the nut assembly 7 and the lower end 23 is not threaded; this prevents the spindle 5 from becoming inadvertantly unscrewed from the nut assembly 7. The spindle 5 has a keyway 26 extending longitudinally from the upper end 22, along the intermediate portion 24 and terminating adjacent the lower end 23.

Inserted within the barrel upper end 19 is a bushing 28 aligning the spindle 5 in the barrel 6 and facilitating rotation of the nut assembly 7 relative to the barrel 6. Preferably, the bushing 28 is formed of a material which is resistent to wear and allows rotational slippage without substantial frictional resistance; that is, provides a bearing surface. The bushing 28 has a lower end 29, FIG. 2, inserted within the barrel 6 and an upper end 30 with a flange 31 overlapping and supported on the barrel abutment edge 20. The bushing 28 has a plurality of longitudinal ribs 32 which engage the inner wall of the barrel 6 and prevent the bushing 28 from rotation.

The nut assembly 7 includes the nut 8 which mounts on the spindle 5 and has an engagement portion 38 for selective contact with the detent member 9. The nut is urged by the biasing means 10 so that the engagement portion 38 contacts and mates with the detent member 9 in the absence of compressive forces, such as when the seat section 3 is unoccupied. The nut 8 is urged away from the detent member 9 by the application of compressive force, as by the weight of an occupant when the seat section 3 is occupied. In the illustrated example, FIGS. 3 and 4, the nut 8 has a cylindrical side wall 39, an upper surface 40, a lower surface 41, a threaded through bore 42 and an annular recess 43 extending downwardly from the upper surface 40 and terminating in a groove or bottom 44 medially positioned between the upper and lower surfaces 40 and 41. The groove or bottom 44 receives the detent member 9 and is particularly adapted for interlocking engagement between the nut 8 and the detent member 9. The groove or bottom 44 includes interlocking means such as surface textures, ridges and the like and in the illustrated example has a series of transverse teeth 45, FIG. 5, formed thereon, as by stamping.

The upper surface 40 has a flange portion 48 extending radially outward and which provides an upper stop to the biasing means 10, as described below. Additionally, the nut lower surface 41 has opposite, radially extending, rounded grooves 50, such as four in number, for a purpose later described.

The biasing means 10 forms a part of the adjusting nut assembly 7 and extends between the adjusting nut 9 and the bushing 28, which is in turn attached to the barrel 6. In the illustrated example, a bearing washer 53, such as flat in configuration, is positioned atop the bushing flange 31 and rings the spindle 5. The washer 53, when pressed against the bushing flange 48 tends to rotate smoothly and easily on the surface of the flange.

In the illustrated example, the biasing means 10 is a coil spring 55 extending circumferentially about the nut circular side wall 39 for mutual alignment. The spring 55 has an upper portion 56, FIGS. 2–4, abutting the bottom of the nut flange 48 and a lower portion 57 abutting the upper side of the washer 53. The coil spring 55 is selected for long lasting recoil qualities and long operational life of the mechanism 1 and is of sufficient strength to extend and lift the overlying weight of the spindle 5 and seat section 3 and any side arms or back rests which may be connected to the seat section 3. The coil spring 55 is also selected to compress with the weight of a person seated upon the seat section 3; such person may be a child and may weigh as little as 50 pounds, yet the exemplary spring 55 will fully compress. The biasing means 10 may be other than a coil spring 55 and may take the form of an elastomeric member or ring, a series of spring washers, or the like.

The nut assembly 7 also includes an interengaging lug or lock-unlock member such as a J-washer 60 which is interposed between the nut 8 at its lower surface 41 and the bearing washer 53 and positioned within the coil spring 55. The J-washer 60 has lugs 61, such as four in number and which are diametrically opposed and engage or fit into the grooves 50 of the nut 8 as described below. The J-washer 60 further has a keyway 63 projecting radially inwardly into the spindle keyway 26 so that the J-washer does not rotate relative to the spindle 5. The array of lugs 61 provide a surface which is sinusoidal in side view and forms a cam lock between the J-washer 60 and the nut 8. Because the J-washer 60 is keyed to the spindle 5, the nut 8 is substantially prevented from rotating relative to the spindle 21 when the coil spring 55 is compressed and the nut 8 urged against the J-washer 60. The weight on the spindle 5, as by a person sitting on the seat section 3, also causes frictional forces between the spindle 5 and the nut 8 which also tend to prevent relative rotation. Of course, when the weight is removed from the seat section 3, the spring 55 urges the nut 8 and J-washer 60 apart, and relative rotation is not prevented.

Figure 3:
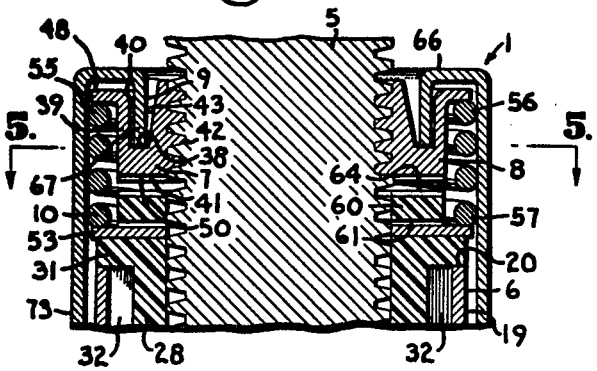
FIG. 3 is an enlarged, fragmentary, sectional view.
Figure 4:
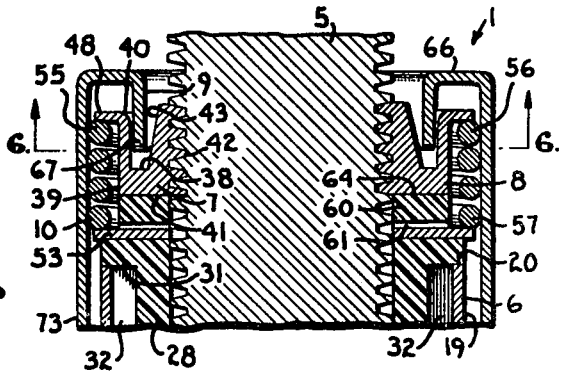
FIG. 4 is a fragmentary, sectional view of the embodiment showing its parts in a second functional mode.
Figure 10:
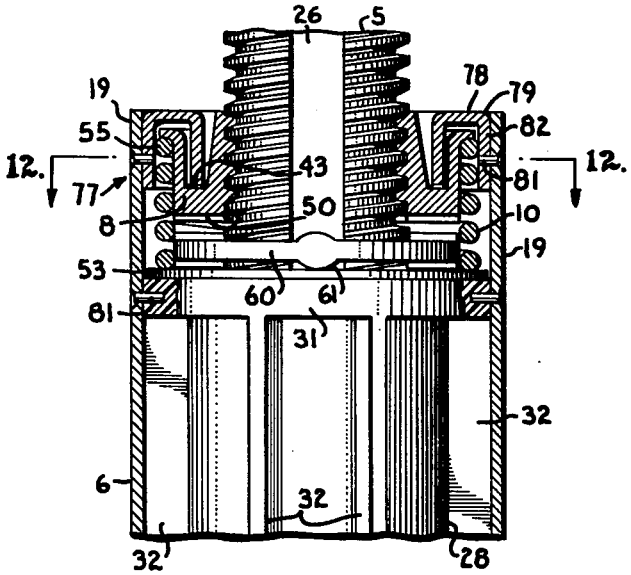
FIG. 10 is a fragmentary, longitudinal sectional view of an alternative embodiment and showing same in one functional mode.
Figure 11:
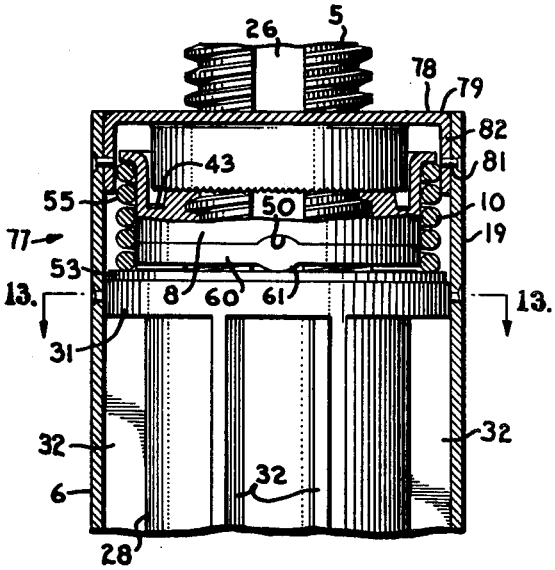
FIG. 11 is a fragmentary, longitudinal sectional view of the alternative embodiment in as second functional mode.
Figure 12:
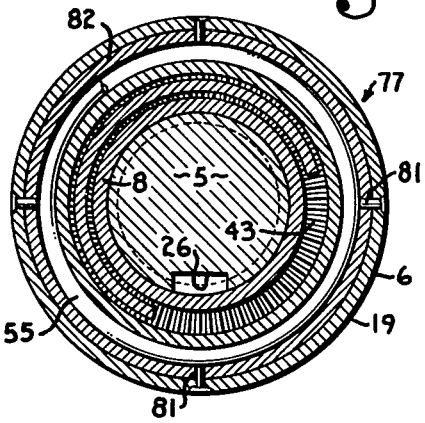
FIG. 12 is a cross-sectional view taken along line 12—12, FIG. 10.
Figure 13:
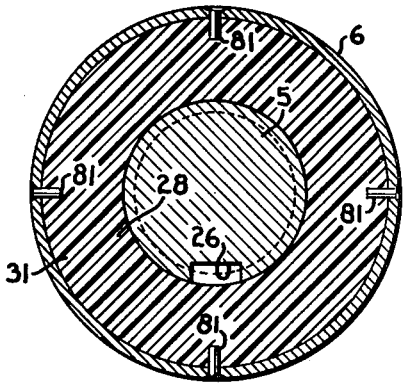
FIG. 13 is a cross-sectional view taken along line 13—13, FIG. 11.
Figure 14:
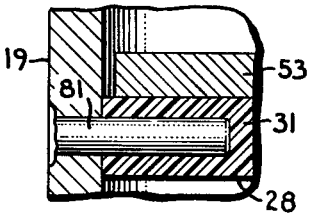
FIG. 14 is an enlarged, fragmentary view showing a detail of construction.

The detent member 9 is connected to the barrel 6 and extends to adjacent the engagement portion 38 to prevent rotation of the nut 8 relative to the barrel 6 when the seat section 3 is unoccupied. As set forth above, the detent member 9 extends radially inward past the upper end of the coil spring 55 and downward past the nut upper surface 40 and into the annular recess 43 to adjacent the groove or bottom 44. The detent member 9 may comprise a single prong or an annular ring, such as shown in FIG. 3. In the illustrated example, the detent member 9 is formed by an outer flange 66 extending radially inwardly past the coil spring 55 and a circular or annular downwardly extending ring 67 which projects into the annular recess 43 of the nut 8. The exemplary ring 67 is continuous, although it is within the concept of the present invention that the ring 67 may not be continuous but may be in the form of spaced, downturned prongs or legs (not shown). The annular ring 67 has means facilitating interlocking engagement between the detent member 9 and the nut 8. These means may include knurled, roughened, abrasive bearing surfaces or the like facilitating interlocking and in the illustrated example, include a plurality or series of transverse teeth 70, FIGS. 6 and 9, which interengage with the teeth 45 in the groove or bottom 44 of the nut recess 43.

In the embodiment shown in FIGS. 1–9, the housing 73 is mounted on and sleeved about the barrel upper end 19 and covers the nut assembly 7 including the coil spring 55. In this embodiment, the detent member 9 is integral with the housing 73. The housing 73 is sized for maintaining the coil spring 55 in alignment with the spindle 5 and is positioned longitudinally on the barrel 6 so that the nut 8 engages the detent member 9 extending from the housing 73 when the seat section 3 is unoccupied. In this position, the coil spring 55 is compressed and the nut 8 disengages the detent member 9. In the illustrated example, the housing 73 is secured to the barrel upper end by fasteners 74.

In use, rotation of the unoccupied seat section 3 accomplishes longitudinal or height adjustment. Conversely, rotation of the occupied seat section 3 does not affect the height of the seat section 3. When the seat section 3 is unoccupied, the coil spring 55 urges the nut 8 upwardly toward and into mating engagement with the detent member 9 which enables rotation of the spindle relative to the nut 8 and chair height is adjusted by rotating the seat section 3 clockwise or counterclockwise. When the seat section 3 is occupied, the coil spring 55 is compressed and the nut 8 urged downwardly by the spindle 5, thereby disengaging from the detent member 9. At the downward extent of travel of the nut 8, its lower surface 41 engages the J-washer 60 to lock the nut 8 to the J-washer and the nut 8 rotates in unison with the spindle 5 because the J-washer 60 is keyed to the spindle; this is simple rotary movement or rotation in the horizontal plane without substantial movement of the vertical plane of the seat section 3 as the seat section 3 and attached spindle 5 rotate due to the occupant swiveling the chair seat.

An alternative embodiment 77 of the present invention is shown in FIGS. 10–14 and bears like numbers to the embodiment shown in FIGS. 1–9 where the parts are the same or substantially the same. In this embodiment, the adjusting nut assembly 7 is set within the barrel 6 at its upper end 19 and the barrel 6 is sleeved about the nut assembly 7 and coil spring 55. The upper end 19 of the barrel 6 has an annular insert 78 fitted within the upper end 19 and which is formed to provide a detent member 79. The bushing 28 is concentrically inserted within the barrel 6 and positioned below the barrel upper end 19. Both the annular insert 78 and the bushing 28 are secured to and fixed in position within the barrel 6 by fasteners 81 such as rivets, set screws or the like extending through the barrel 6 and into the annular insert 78 at the upper portion and into the bushing 28 lower down. The insert 78 in the illustrated example is annular and is intended to match the annular configuration of the barrel 6; however, both may be of square or even rectangular configuration as desired for ornamental purposes. The insert 78 has an outer ring 82 extending parallel to the barrel bore and sized for an interference fit within the barrel upper end 19.

The insert 78 includes the outer ring 82, a top flange 83 and an inner ring 84 with the top flange 83 and inner ring 84 respectively corresponding to the flange 66 and ring 67 of the embodiment shown in connection with FIGS. 1–9. The inner ring 84 is sized in diameter so that the spindle 5 extends therethrough without contact or interferance and projects downwardly to engage the nut groove or bottom 44. The insert 78 may be a simple, one-piece stamping and facilitates low cost construction.

Use of the alternative embodiment shown in FIGS. 10–14 is the same as used in the first embodiment shown in FIGS. 1–9.

It is to be understood that while certain forms of the present invention have been illustrated and described herein, it is not to be limited to the specific forms or arrangement of parts described and shown.

What is claimed and desired to be secured by Letters Patent is as follows:

1. A chair height adjustment mechanism for selectively positioning a swivelable seat section relative to a base; said mechanism comprising:

(a) a barrel attached to and extending upwardly from said base and having an upper end;

(b) a threaded spindle having a longitudinal keyway and extending downwardly from said seat section and telescopically received within said barrel;

(c) a bushing aligning said spindle within said barrel and having a lower end inserted in said barrel and an upper end including a flange overlapping said barrel distal end;

(d) a bearing washer slidably mounted on said bushing upper end and having said spindle extending therethrough;

(e) a nut threadably engaging said spindle and having a circular sidewall and an upper and a lower surface; said upper surface having a flange extending radially therefrom and an annular recess extending downwardly from said upper surface and terminating in a groove bottom medially positioned between said upper and lower surfaces; said groove bottom facing upwardly and having teeth thereon; said lower surface having transverse grooves therein;

(f) a coil spring sleeved about said nut and extending beyond said groove bottom; said spring having an upper end abutting said flange of said nut and a lower end abutting said bearing washer, thereby urging said nut and spindle upwardly relative to said barrel; said nut sidewall maintaining alignment of said spring and said spindle;

(g) a J-washer interposed between said nut and said flat washer and contained within said spring lower end, said J-washer having an upper surface with lugs thereon opposing said nut lower surface and including a key extending into said keyway and preventing rotation of said J-washer relative to said spindle;

(h) a housing sleeved about said barrel distal end, bushing, washer, J-washer, nut and spring; said housing having a diameter sized for maintaining said coil spring in alignment with said spindle; said housing including a detent portion extending radially inward past said coil spring and longitudinally downward toward said groove bottom and having teeth thereon;

(i) whereby when said seat section is occupied, said spring is compressed urging said nut to disengage said detent portion, move downwardly and lock against said J-washer and to rotate in unison with said spindle, thereby facilitating simple rotary movement and nonadjustment as said seat section swivels;

(j) whereby when said seat section is unoccupied said spring urges said nut from said J-washer and into engagement with said detent member and hold said nut in non-rotative relationship to said barrel, thereby facilitating rotary movement of said spindle relative to said nut and barrel and causing longitudinal chair height adjustment.

2. A chair height adjustment mechanism for selectively positioning a swivelable seat section relative to a base; said mechanism comprising:

(a) a barrel attached to and extending upwardly from said base and having an upper end;

(b) a threaded spindle having a longitudinal keyway and extending downwardly from said seat section and telescopically received within said barrel; and (c) a bushing aligning said spindle within said barrel inserted within said barrel, and having an upper end spaced downwardly from said barrel upper end;

(d) a bearing washer slidably mounted on said bushing upper end and having said spindle extending therethrough;

(e) a nut threadably engaging said spindle and having a circular sidewall and an upper and a lower surface; said upper surface having a flange extending radially therefrom and an annular recess extending downwardly from said upper surface and terminating in a groove bottom medially positioned between said upper and lower surfaces; said groove bottom facing upwardly and having teeth thereon; said lower surface having transverse grooves therein;

(f) a coil spring sleeved about said nut and extending beyond said groove bottom; said spring having an upper end abutting said flange of said nut and a lower end abutting said bearing washer, thereby urging said nut and spindle upwardly relative to said barrel; said nut sidewall maintaining alignment of said spring and said spindle;

(g) a J-washer interposed between said nut and said flat washer and contained within said spring lower end, said J-washer having an upper surface with lugs thereon opposing said nut lower surface and including a key extending into said keyway and preventing rotation of said J-washer relative to said spindle;

(h) means fixing said bushing to said barrel below said barrel upper end with said barrel concentrically enveloping said bearing washer, J-washer, nut and spring;

(i) a detent member comprising an annular insert having an outside diameter sized for an interference fit within said barrel upper end and an inside diameter sized for free movement of said spindle therethrough; said detent member having a ring extending downwardly toward said groove bottom and having teeth thereon for mating engagement therewith;

(j) whereby when said seat section is occupied, said spring is compressed, urging said nut to disengage said detent member, moves downwardly and lock against said J-washer and to rotate in unison with said spindle, thereby facilitating simple rotary movement and non-adjustment as said seat section swivels;

(k) whereby when said seat section is unoccupied said spring urges said nut from said J-washer and into engagement with said detent member and hold said nut in non-rotative relationship to said barrel, thereby facilitating rotary movement of said spindle relative to said nut and barrel causing longitudinal chair height adjustment.

3. A chair height adjustment mechanism for selectively positioning a swivelable seat section relative to a base, said mechanism comprising:

(a) a barrel attached to and extending upwardly from said base and terminating at a distal end;

(b) a threaded spindle connected to and extending downward from said seat section and telescopically received within said barrel distal end;

(c) an adjusting nut assembly extending between said barrel and said spindle and including a nut threadably mounted on said spindle;

(d) a spring positioned between said nut and said barrel and resiliently urging said nut and spindle upwardly relative to said barrel;

(e) a detent member connected to and extending from said barrel and having means for interlocking engagement with said nut;

(f) whereby when said seat section is occupied, said spring is compressed and said spindle moved downwardly within said barrel, disengaging said nut from detent member for rotation in unison with said spindle when said seat section is swiveled for non-adjustment of said seat section relative to said base;

(g) whereby when said seat section is unoccupied, said spring urges said nut into engagement with said detent member and said spindle rotates relative to said nut when said seat section is swiveled and causing longitudinal chair height adjustment;

(h) said nut having an upper surface with a flange extending radially therefrom;

(i) said spring having an upper end abutting said flange and a lower end mounted to said barrel, thereby urging said nut upward relative to said barrel;

(k) said spring being a coil spring surrounding said nut;

(l) said nut having an annular recess extending downwardly from said upper surface and terminating in a groove bottom positioned between said upper and lower surfaces;

(m) said detent member extending downwardly into said annular recess to adjacent said groove bottom;

(n) said spring radially surrounding said groove bottom and urging said nut and spindle upwardly toward engagement between said groove bottom and said detent member.

4. A chair height adjustment mechanism for selectively positioning a swivelable seat section relative to a base, said mechanism comprising:

(a) a barrel attached to and extending upwardly from said base and terminating at a distal end;

(b) a threaded spindle connected to and extending downward from said seat section and telescopically received within said barrel distal end;

(c) an adjusting nut assembly extending between said barrel and said spindle and including a nut threadably mounted on said spindle, having an upper surface with a flange extending radially therefrom, and an annular recess extending downwardly from said upper surface and terminating in a groove bottom having teeth therein and positioned between said upper surface and a nut lower surface;

(d) a coil spring surrounding said nut and said barrel and having an upper end abutting said flange and a lower end mounted to said barrel, thereby resiliently urging said nut and spindle upwardly relative to said barrel, (e) a detent member connected to and extending from said barrel and having a ring with teeth thereon for interlocking engagement with said teeth of said groove bottom of said nut, said detent member extending downwardly into said annular recess to adjacent said groove bottom whereby said teeth of said ring and said groove bottom are urged into interlocking engagement with said spring when said seat section is unoccupied; and (f) whereby when said seat section is occupied, said spring is compressed and said spindle moved downwardly within said barrel, disengaging said nut from detent member for rotation in unison with said spindle when said seat section is swiveled for non-adjustment of said seat section relative to said base;

(g) whereby when said seat section is unoccupied, said spring urges said nut into engagement with said detent member and said spindle rotates relative to said nut when said seat section is swiveled and causing longitudinal chair height adjustment.

5. A chair height adjustment mechanism for selectively positioning a swivelable seat section relative to a base; said mechanism comprising:

(a) a barrel attached to and extending upwardly from said base and having an upper end;

(b) a threaded spindle having a longitudinal keyway, extending downwardly from said seat section and telescopically received within said barrel; and (c) a bushing aligning said spindle within said barrel inserted within said barrel, and having an upper end spaced downwardly from said barrel upper end;

(d) a bearing washer slidably mounted on said bushing upper end and having said spindle extending therethrough;

(e) a nut threadably engaging said spindle and having a sidewall and an upper and a lower surface; said upper surface having a flange extending radially therefrom and an annular recess extending downwardly from said upper surface and terminating in a groove bottom medially positioned between said upper and lower surfaces;

(f) a coil spring sleeved about said nut and extending beyond said groove bottom; said spring having an upper end abutting said flange of said nut and a lower end abutting said bearing washer, thereby urging said nut and spindle upwardly relative to said barrel; said nut sidewall maintaining alignment of said spring and said spindle;

(g) a J-washer interposed between said nut and said flat washer and contained within said spring lower end, said J-washer having an upper surface with lugs thereon opposing said nut lower surface and including a key extending into said keyway and preventing rotation of said J-washer relative to said spindle;

(h) means fixing said bushing to said barrel below said barrel upper end with said barrel concentrically enveloping said bearing washer, J-washer, nut and spring;

(i) a detent member comprising an annular insert having an outside diameter sized for an interference fit within said barrel upper end and an inside diameter sized for free movement of said spindle therethrough; said detent member having a ring extending downwardly toward said groove bottom for mating engagement therewith;

(j) whereby when said set section is occupied, said spring is compressed, urging said nut to disengage said detent member, move downwardly and lock against said J-washer and to rotate in unison with said spindle, thereby facilitating simple rotary movement and non-adjustment as said seat section swivels;

(k) whereby when said seat section is unoccupied said spring urges said nut from said J-washer and into engagement with said detent member and hold said nut in non-rotative relationship to said barrel, thereby facilitating rotary movement of said spindle relative to said nut and barrel causing longitudinal chair height adjustment.

6. A chair height adjustment mechanism for selectively positioning a swivelable seat section relative to a base; said mechanism comprising:

(a) a barrel attached to and extending upwardly from said base and having an upper end;

(b) a threaded spindle having a longitudinal keyway extending downwardly from said seat section and telescopically received within said barrel;

(c) a bushing aligning said spindle within said barrel and having a lower end inserted in said barrel and an upper end including a flange overlapping said barrel distal end;

(d) a bearing washer slidably mounted on said bushing upper end and having said spindle extending therethrough;

(e) a nut threadably engaging said spindle and having a sidewall and an upper and a lower surface; said upper surface having a flange extending radially therefrom and an annular recess extending downwardly from said upper surface and terminating in a groove bottom medially positioned between said upper and lower surfaces;

(f) a coil spring sleeved about said nut and extending beyond said groove bottom; said spring having an upper end abutting said flange of said nut and a lower end abutting said bearing washer, thereby urging said nut and spindle upwardly relative to said barrel; said nut sidewall maintaining alignment of said spring and said spindle;

(g) a J-washer interposed between said nut and said flat washer and contained within said spring lower end, said J-washser having an upper surface with lugs thereon opposing said nut lower surface and including a key extending into said keyway and preventing rotation of said J-washer relative to said spindle;

(h) a housing sleeved about said barrel distal end, bushing, washer, J-washer, nut and spring; said housing having a diameter sized for maintaining said coil spring in alignment with said spindle; said housing including a detent portion extending radially inward past said coil spring and longitudinally downward toward said groove bottom;

(i) whereby when said seat section is occupied, said spring is compressed urging said nut to disengage said detent portion, move downwardly and lock against said J-washer and to rotate in unison with said spindle, thereby facilitating simple rotary movement and nonadjustment as said seat section swivels;

(j) whereby when said seat section is unoccupied said spring urges said nut from said J-washer and into engagement with said detent member and hold said nut in non-rotative relationship to said barrel, thereby facilitating rotary movement of said spindle relative to said nut and barrel and causing longitudinal chair height adjustment.

* * * * *